US009158227B1

(12) United States Patent
Watanabe et al.

(10) Patent No.: US 9,158,227 B1
(45) Date of Patent: Oct. 13, 2015

(54) DEVELOPING ROLLER AND DEVELOPING APPARATUS AND IMAGE FORMING APPARATUS USING THE SAME

(71) Applicant: KYOCERA Document Solutions Inc., Osaka-shi, Osaka (JP)

(72) Inventors: Yukimasa Watanabe, Osaka (JP); Sakae Saito, Osaka (JP); Hiroaki Sakai, Osaka (JP); Yasuhiro Oishi, Osaka (JP); Masashi Fujishima, Osaka (JP); Chikara Ishihara, Osaka (JP); Yasuhiro Tauchi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/687,064

(22) Filed: Apr. 15, 2015

(30) Foreign Application Priority Data

Apr. 21, 2014 (JP) ..... 2014-087299

(51) Int. Cl.
*G03G 15/08* (2006.01)
*G03G 15/09* (2006.01)

(52) U.S. Cl.
CPC ..... *G03G 15/0808* (2013.01); *G03G 15/09* (2013.01)

(58) Field of Classification Search
CPC ..... G03G 15/0808; G03G 15/09
See application file for complete search history.

(56) References Cited

U.S. PATENT DOCUMENTS

2004/0228661 A1 11/2004 Fujishima et al.
2008/0075505 A1* 3/2008 Nagamori et al. ..... 399/176

FOREIGN PATENT DOCUMENTS

JP 2004-318092 11/2004

* cited by examiner

*Primary Examiner* — G. M. Hyder
(74) *Attorney, Agent, or Firm* — Gerald E. Hespos; Michael J. Porco; Matthew T. Hespos

(57) ABSTRACT

The present disclosure relates to a developing roller having a conductive support base, a surface of which is covered with a resin layer, wherein the resin layer contains conductive fine particles and soluble nylon serving as a binder resin, and the resin layer surface has a surface roughness Ra of at least 0.4 μm, a waviness curve cycle of 50 to 400 μm, and a waviness curve height of 2 to 10 μm.

7 Claims, 10 Drawing Sheets

DEVELOPING ROLLER AND DEVELOPING APPARATUS AND IMAGE FORMING APPARATUS USING THE SAME

The present disclosure is based on Japanese Patent Application No. 2014-087299 filed to the Japanese Patent Office on Apr. 21, 2014, the contents of which is incorporated herein by reference.

BACKGROUND

The present disclosure relates to a developing roller used for image forming apparatuses utilizing an electrophotographic scheme, such as a copier, a printer, a facsimile machine, and a multifunction printer that is a combination of a copier, a printer, and a facsimile machine, and a developing apparatus and an image forming apparatus using the developing roller.

In an electrophotographic process, an electrostatic latent image is formed on a photoreceptor, and the electrostatic latent image is developed into a toner image by a developing apparatus. The toner image on the photoreceptor is transferred to a sheet, and the toner image on the sheet is fixed by a fixing apparatus. An example of such a developing apparatus used for an image forming apparatus forms and holds a two-component developer containing a magnetic carrier and toner, on a magnetic roller as a magnetic brush, uses the magnetic brush to form a thin toner layer on the developing roller, and feeds the toner to the photoreceptor to develop the electrostatic latent image formed on the photoreceptor in a noncontact manner.

It is known that, in a developing apparatus based on this developing scheme, a surface of a developer carrier (developing roller) is provided with roughness to reduce the contact area between the developing roller and toner, thus improving development properties.

As a method for providing the surface of the developer carrier (developing roller) with roughness, for example, the following are known: a method of applying surface roughness by mechanically roughening a surface of a support base providing the roller (sandblasting or the like) and a method of applying surface roughness to a roller with a resin layer formed on the support base and including a binder resin, by adding fine particles s to the resin layer.

SUMMARY OF INVENTION

A developing roller according to an aspect of the present disclosure is a developing roller having a conductive support base, a surface of which is covered with a resin layer, wherein the resin layer contains conductive fine particles and soluble nylon serving as a binder resin and the resin layer surface has a surface roughness Ra of at least 0.4 μm, a waviness curve cycle of 50 to 400 μm, and a waviness curve height of 2 to 10 μm.

DESCRIPTION OF EMBODIMENTS

An embodiment according to the present disclosure will be described below. However, the present disclosure is not limited to the embodiment.

[Developing Roller]

A developing roller according to the present embodiment is a developing roller in which a surface of a conductive support base is covered with a resin layer, the developing roller being characterized in that the resin layer contains conductive fine particles and soluble nylon serving as a binder resin and in that the surface of the resin layer has a surface roughness Ra of at least 0.4 μm, a waviness curve cycle of 50 to 400 μm, and a waviness curve height of 2 to 10 μm.

Such a configuration provides a developing roller that can be inexpensively and relatively easily obtained while exhibiting excellent developing performance, and a developing apparatus and an image forming apparatus that provide stable images.

The developing roller according to the present embodiment will be described with reference to the drawings. Terms such as "up", "down", "right" and "left which are used herein to represent directions are simply intended to clarify the description and do not limit the present disclosure.

FIG. 1 is a schematic configuration diagram of a developing roller 61 according to the present embodiment. FIG. 1A is a cross-sectional view of an example of the developing roller 61, and FIG. 1B is a perspective view of the developing roller 61 depicted in FIG. 1A. FIG. 1C is a cross-sectional view of another example of the developing roller 61, and FIG. 1D is a perspective view of the developing roller 61 depicted in FIG. 1C.

Figure 1A:
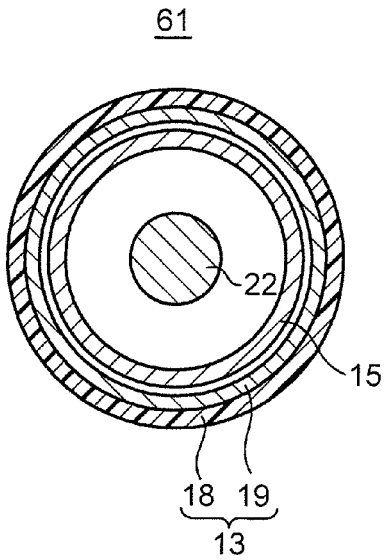
FIGS. 1A to 1D are schematic diagrams depicting the structure of a developing roller according to an embodiment of the present disclosure.
Figure 1B:
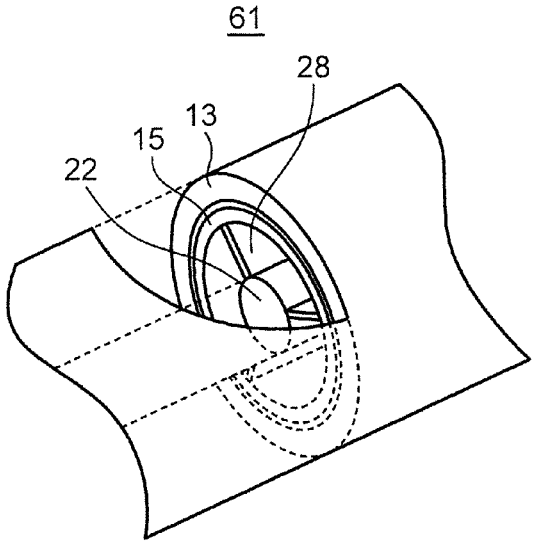

First, the developing roller 61 depicted in FIG. 1A will be described. As depicted in FIG. 1A and FIG. 1B, the developing roller 61 includes a cylindrical rotating sleeve 13 and a fixed shaft 15 contained in the rotating sleeve 13. With the position of the fixed shaft 15 fixed, the rotating sleeve 13 rotates around the fixed shaft 15.

As depicted in FIG. 1A and FIG. 1B in the rotating sleeve 13, a surface of a support base 19 is covered with a resin layer 18. The support base 19 is, for example, a cylindrical member formed of aluminum, stainless steel, or the like. Furthermore, the fixed shaft 15 is coupled via a plurality of ribs 28 to a shaft 22 pivotally supported by a developing unit 20.

In this regard, the resin layer 18 covering the surface of the conductive support base of the developing roller according to the present embodiment contains, as basic components, at least conductive fine particles and soluble nylon serving as a binder resin.

The binder resin providing the resin layer 18 according to the present embodiment is soluble nylon. Examples of the soluble nylon resin include a copolyamide resin, a methoxymethylated nylon resin, and a polymerized fatty acid nylon resin. One type of soluble nylon resin may be singularly used or two or more types of soluble nylon resins may be used together. The use of such a soluble nylon resin as a binder resin has the advantages of needing reduced costs and facilitating device design.

The resin layer 18 may further contain a resin other than the soluble nylon resin as a binder resin. As another resin contained in the resin layer 18, a well-known binder resin may be used. Specifically, examples of such a binder resin include thermoplastic resins such as a polycarbonate resin such as bisphenol Z, bisphenol ZC, bisphenol C, or bisphenol A, a polyarylate resin, a styrene-butadiene copolymer, a styrene-acrylonitrile copolymer, a styrene-maleic acid copolymer, an acrylic copolymer, a styrene-acrylic acid copolymer, a polyethylene resin, an ethylene-vinyl acetate copolymer, a chlorinated polyethylene resin, a polyvinyl chloride resin, a polypropylene resin, an ionomer resin, a vinyl chloride-vinyl acetate copolymer, an alkyd resin, a polyurethane resin, a polysulfone resin, a diallylphthalate resin, a ketone resin, a polyvinyl acetal resin, a polyvinyl butyral resin, and a polyether resin; thermosetting resins such as a silicone resin, an epoxy resin, a phenol resin, a urea resin, and a melamine resin; and photocurable resins such as epoxy acrylate and urethane-acrylate. Another type of resin may be singularly used or two or more other types of resins may be used together.

The content of resin in the resin layer 18 is normally 25 to 80 mass % of the whole material constituting the resin layer 18 and is preferably 35 to 70 mass %, although the content depends on a solution viscosity.

Furthermore, the resin layer 18 of the present embodiment contains conductive fine particles. This allows for adjustment to a desired resistance value.

Examples of the conductive fine particles include particles of metal or metal oxide and carbon. Specific examples include aluminum, iron, copper, titanium oxide, silica, alumina, zirconium oxide, tin oxide, zinc oxide, and indium oxide. In particular, titanium oxide is preferable. Furthermore, when titanium oxide is used, the titanium oxide may be subjected to surface treatment with alumina, silica, or the like and then with silicone or the like.

The conductive fine particles preferably have an average primary particle size of 500 nm or less, and more preferably 10 to 100 nm. When the average primary particle size exceeds 500 nm, leakage may occur between photoreceptors, with the conductive fine particles serving as a start point of the leakage.

The thickness of the resin layer 18 is not particularly limited but is preferably approximately 2 to 20 μm and more preferably approximately 3 to 15 μm. When the thickness is smaller than 2 μm, the resin layer 18 may fail to complete the lifespan thereof when worn by long-time use. On the other hand, when the thickness is larger than 20 μm, charge tends to build up in the film and this is not preferable.

The content of the conductive fine particles in the resin layer 18 is preferably 20 to 300 parts by mass and more preferably 40 to 200 parts by mass with respect to 100 parts by mass binder resin.

In the present embodiment, besides the binder resin and conductive fine particles as described above, any other component (for example, a leveling agent) may be contained in the resin layer 18 to the extent that the effects of the present disclosure are not hindered. Furthermore, appropriate amounts of various additives may be added as needed.

Figure 1C:
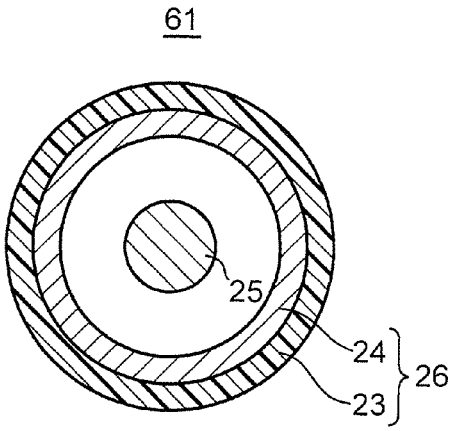
Figure 1D:
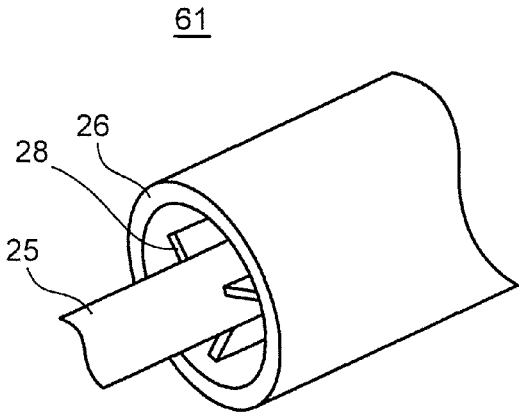

Now, the developing roller 61 depicted in FIG. 1C will be described. As depicted in FIG. 1C and FIG. 1D, the developing roller 61 includes a roller main body 24 and a resin layer 23 covering a surface of the roller main body 24. The roller main body 24 is pivotally supported by flanges (with bearings) fitted at opposite ends of the roller main body 24 so as to be rotatable with respect to a shaft 25. The flange on one end side is provided with a gear to receive an external driving force. The roller main body 24 is, for example, what is called a three-arrow-shaped tube formed of aluminum or stainless steel. The resin layer 23 may be similar to the resin layer 18.

A method for manufacturing the developing roller 61 as described above is not particularly limited. For example, for the developing roller 61 depicted in FIG. 1A, for example, first, a method for forming the resin layer 18 may be a method of mixing a solvent with a resin composition containing the above-described binder resin and conductive fine particles and any other additive as needed to obtain a resin coating agent, coating the resin coating agent on the surface of the support base 19 of the developing roller, and heating the surface.

Furthermore, for the developing roller 61 depicted in FIG. 1C, for example, the resin coating agent is applied onto the roller main body 24, which is then heated. This allows the resin layer 23 to be formed on the roller main body 24 to manufacture the developing roller 61.

Moreover, in the present embodiment, a solvent used for the resin coating agent is preferably a solvent containing alcoholic solvent and a non-aqueous solvent. The compounding ratio of the non-aqueous solvent to the whole solvent is desirably at least 30%. The use of a resin coating agent containing such a solvent allows provision of a developing roller with a surface roughness with a desired shape and enables high developing performance to be exhibited, with no need for extra costs. In particular, adverse effects such as development ghosts can be reliably prevented.

The alcoholic solvent is not particularly limited, and examples of the alcoholic solvent include methanol, ethanol, and butanol.

The non-aqueous solvent is not particularly limited, and examples of the non-aqueous solvent include organic solvents such as xylene, toluene, chlorobenzene and dichloroethane.

The compounding ratio between the alcoholic solvent and the non-aqueous solvent is preferably adjusted such that the compounding ratio of the non-aqueous solvent to the whole solvent is at least 30% and more preferably at least 33%.

When such a solvent is added to the resin composition, the amount of solvent added is preferably adjusted such that the concentration of solids is approximately 10 to 50 mass % in the resin coating agent with the conductive fine particles dispersed therein.

As a method for applying the resin composition and a resin solution to the roller, a conventionally known method may be used, but a dipping method is preferably adopted which involves immersing a developing roller with no resin layer in a resin liquid serving as a dip liquid. This has the advantage of allowing inexpensive production of stably uniform coated articles.

Furthermore, the temperature of heating after coating the resin coating agent is preferably, for example, 70 to 150° C. A heating time is preferably, for example, 30 to 60 minutes.

For the developing roller of the present embodiment thus obtained, the surface of the resin layer has a surface roughness Ra of at least 0.4 μm, a waviness curve cycle of 50 to 400 μm, and a waviness curve height of 2 to 10 μm.

Figure 2:
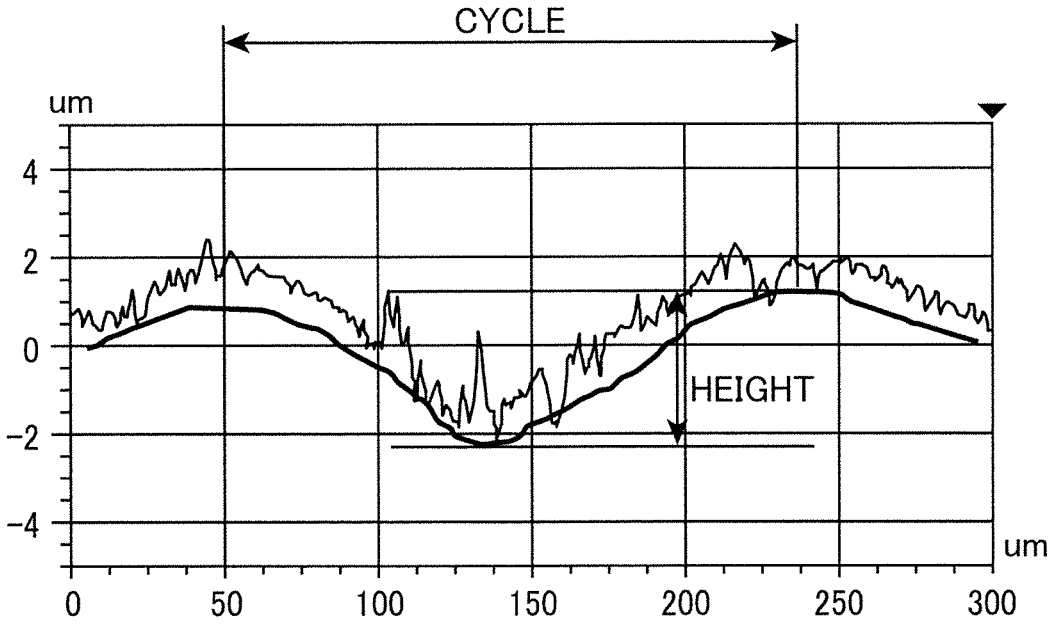
FIG. 2 is a diagram depicting the shape of surface roughness of the developing roller according to the embodiment of the present disclosure.

In this case, the cycle and height of the waviness curve refer to the cycle and height of a wavy shape as shown in FIG. 2. The surface roughness of the resin layer having such a shape has a shape different from the shape of roughness resulting from addition of fine particles.

Figure 3:
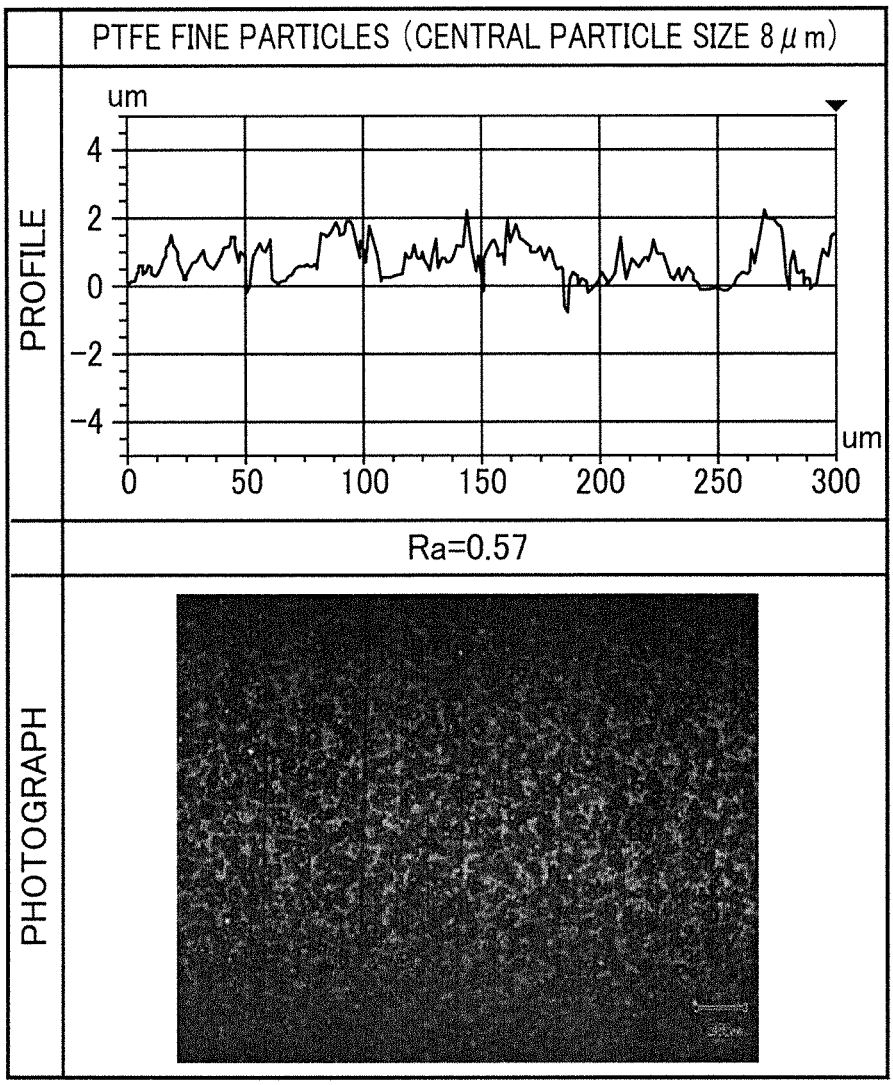
FIG. 3 is a diagram depicting the shape of the surface roughness of the developing roller resulting from the fine particles added to a resin layer.
Figure 4:
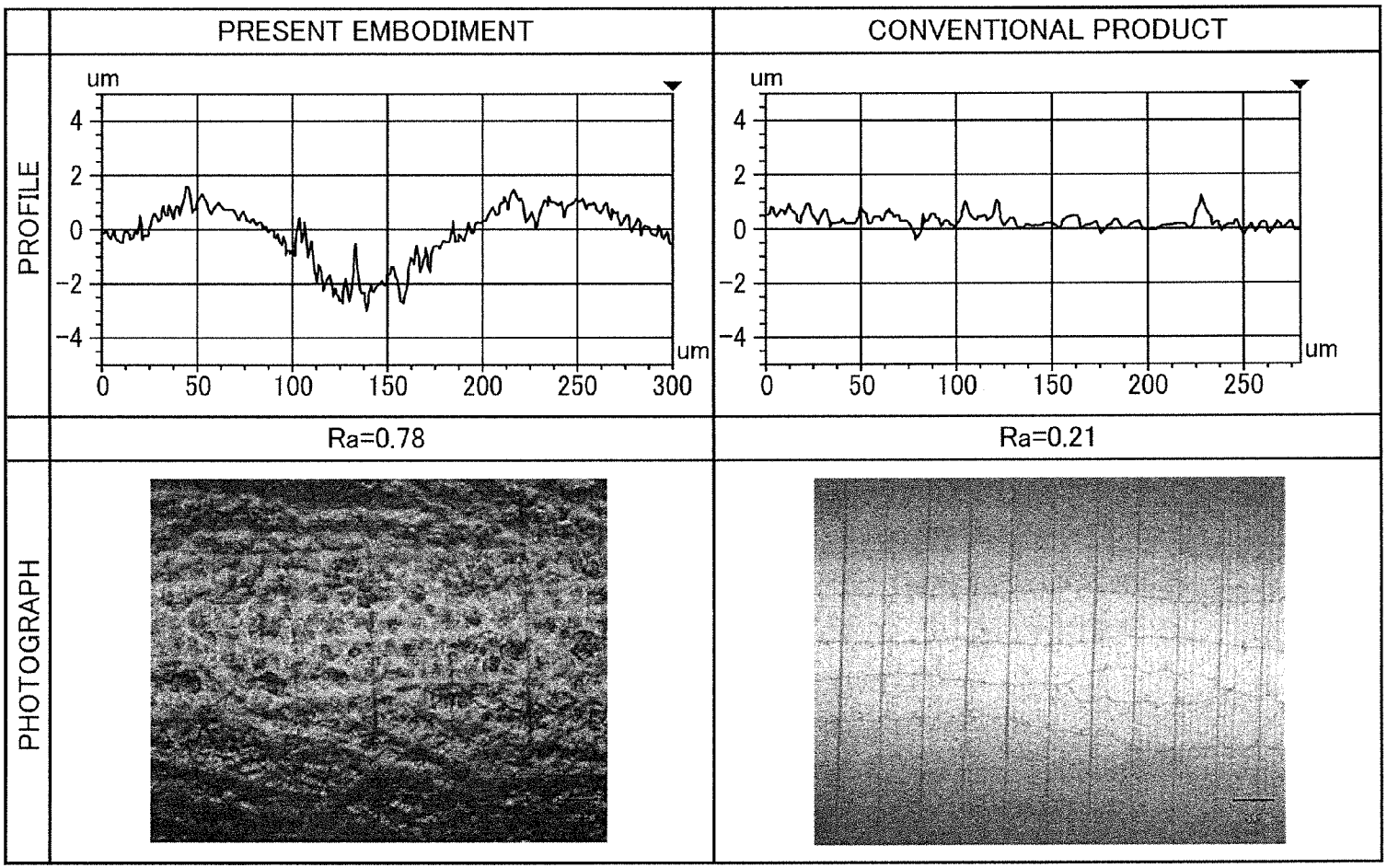
FIG. 4 is a diagram depicting the shape of surface roughness of the developing roller according to the embodiment of the present disclosure (left diagram) and a diagram depicting the surface roughness of a conventional developing roller (right diagram)

More specifically, this can be understood from an obvious difference in shape observed in a comparison of the shape of a surface roughness resulting from addition of PTFE (polytetrafluoroethylene) fine particles (central particle size: 8 μm) illustrated in FIG. 3 or polyethylene fine particles (central particle size: 14 μm) to the resin layer (nylon 6, nylon 66, nylon 610, or nylon 12; four-component copolymer resin) with the shape of the surface roughness of the resin layer of the present embodiment depicted in FIG. 4 (left diagram in FIG. 4). The surface roughness resulting from the addition of fine particles has no waviness curve as observed in the resin layer of the present embodiment.

Furthermore, in the present embodiment, the surface roughness shape of the resin layer resulting from adjustment of the solvent in the coating agent is also obviously different from the surface shape of a conventional resin layer (a resin layer departing from the scope of the present disclosure (the ratio of the non-aqueous solvent is 17%)) (right diagram in FIG. 4).

When the surface of the developing roller has a particular shape as in the present embodiment, the adverse effect of addition of extra particles which is related to the triboelectric series of the resin and the like can be suppressed, and adverse effects such as development ghosts can be reliably prevented. For example, fluorine resin fine particles such as PTFE fine particles are on a negative side of the triboelectric series as opposed to toner that is positively charged. Thus, this is estimated to produce an adverse effect.

Furthermore, in the present embodiment, the surface roughness of the developing roller preferably does not originate from the surface roughness of the support base. That is, in the above-described developing roller, the conductive support base 19 has a surface roughness Ra of 0.6 μm or less. When the surface roughness of the developing roller thus does not originate from the surface roughness of the support base, advantageously the costs are reduced and adjustment during manufacture is facilitated. This is because the manufacture of the developing roller involves a step of coating the surface with a resin liquid forming the resin layer and control during the coating is facilitated. The coating generally tends to smooth the surface roughness of the support base instead of directly reflecting the surface roughness. Hence, when the surface roughness of the roller is adjusted based on the surface roughness of the support base, managing the viscosity of the coating liquid and a coating film thickness is disadvantageously difficult.

Moreover, in the above-described developing roller, the surface roughness of the surface of the resin layer is preferably prevented from resulting from the fine particles contained in the resin layer. This provides a developing roller that, in spite of the surface roughness thereof and the shape of the roughness, enables the adverse effect related to the triboelectric series to be suppressed, reliably preventing the adverse effects such as development ghosts.

[Developing Apparatus]

Figure 5:
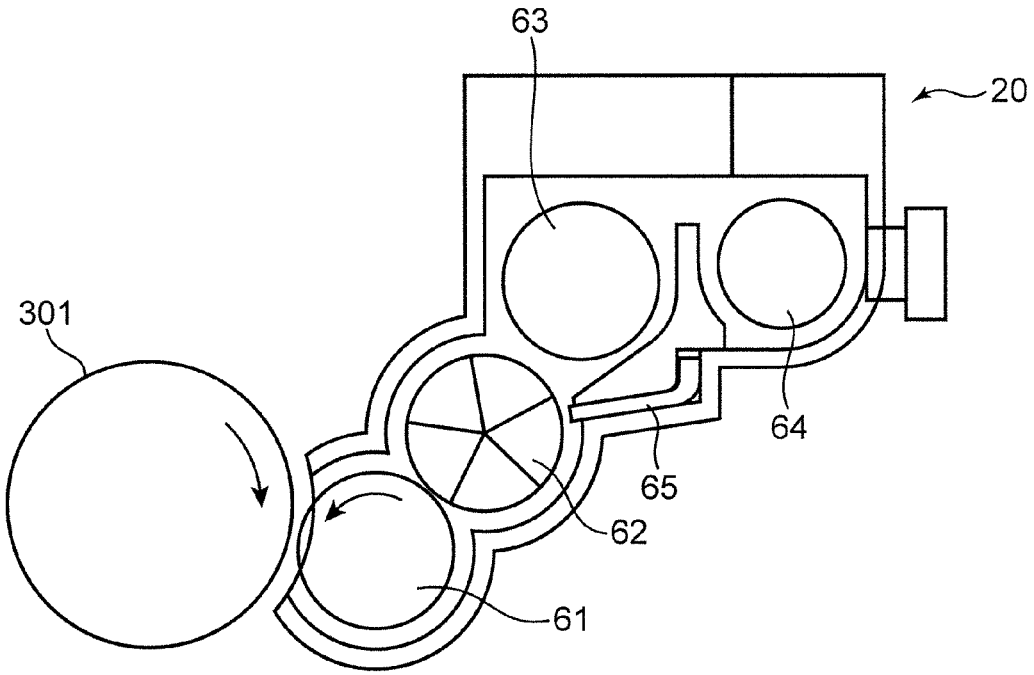
FIG. 5 is a schematic cross-sectional view depicting a developing apparatus according to the embodiment of the present disclosure.

The developing unit (developing apparatus) 20 according to the embodiment of the present embodiment will be described. The developing apparatus according to the embodiment of the present disclosure is what is called a touchdown developing apparatus. The developing apparatus according to the embodiment of the present disclosure is not particularly limited as long as the apparatus includes the above-described developing roller, and is, for example, as depicted in FIG. 5. That is, the developing apparatus develops an electrostatic latent image formed on a surface of an image carrier into a toner image. The developing apparatus includes a magnetic roller carrying a two-component developer containing toner and a carrier on a surface of the roller to convey the borne two-component developer, and a developing roller arranged opposite the image carrier and opposite the magnetic roller in contact with or proximity to the two-component developer conveyed by the magnetic roller to carry the toner in the two-component developer on a surface of the roller to convey the borne toner to the vicinity of the carrier. The developing apparatus is characterized by using, as the developing roller, a roller in which at least a surface portion thereof includes a resin layer containing titanium oxide particles and a resin.

FIG. 5 is a schematic cross-sectional view depicting the developing unit 20 along with a photoreceptor drum 301.

The developing unit 20 is a developing apparatus based on the touchdown development scheme, and includes the developing roller 61, a magnetic roller 62, stirring rollers 63 and 64, and a blade 65.

The stirring rollers 63 and 64 have spiral blades and stir the two-component developer while conveying the two-component developer in the opposite directions, to charge the toner in the two-component developer. Moreover, the stirring roller 63 supplies the two-component developer containing the charged toner and the carrier to the magnetic roller 62.

The magnetic roller 62 allows the two-component developer to be attracted to the roller 62 by means of a magnet fixedly arranged inside to transport the two-component developer. At this time, the two-component developer acts as a magnetic brush under the effect of the magnet inside the magnetic roller 62. When the magnetic brush passes between the blade 65 and the magnetic roller 62, the thickness of the magnetic brush is regulated. Then, the toner in the two-component developer conveyed to the vicinity of the developing roller 61 is transferred to the developing roller 61 by voltages applied to the developing roller 61 and the magnetic roller 62.

The developing roller 61 carries the toner transferred from the magnetic roller 62 on the surface of the roller 61 and conveys the toner. Then, the toner conveyed to the vicinity of the photoreceptor drum 301 is transferred to the photoreceptor drum 301 when the potential difference between the photoreceptor drum 301 and the developing roller 61 meets a predetermined condition.

Through the above-described operations, the developing unit 20 performs development based on the electrostatic latent image formed on the photoreceptor drum 301.

The use of the developing apparatus configured as described above allows stable, high-quality images to be formed.

[Image Forming Apparatus]

Figure 6:
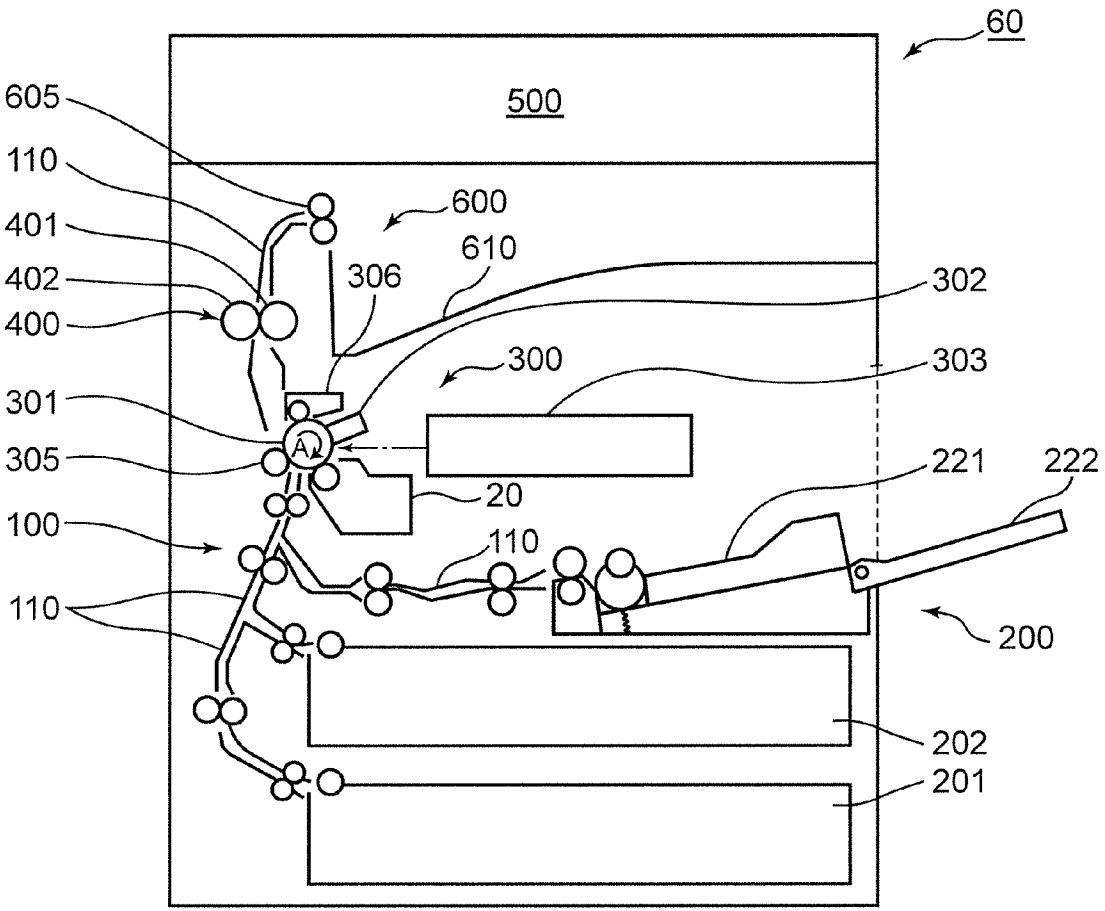
FIG. 6 is a schematic diagram depicting a configuration of an image forming apparatus (copier) to which the developing apparatus according to the embodiment of the present disclosure is applied.

Now, the image forming apparatus according to the present embodiment will be described. The image forming apparatus according to the present embodiment is not particularly limited as long as the apparatus includes the developing apparatus and image carrier as described above. The image forming apparatus to which the developing apparatus according to the embodiment of the present disclosure is applied will be described taking a copier 60 depicted in FIG. 6 by way of an example. FIG. 6 is a schematic diagram depicting a configuration of the image forming apparatus (copier) to which the developing apparatus according to the embodiment of the present disclosure is applied. The copier 60 is what is called an in-body paper discharging copier including a sheet feeding section 200 disposed below a copier main body, an image forming section 300 disposed above the sheet feeding section 200, a fixing section 400 disposed on a discharge side with respect to the image forming section 300, an image reading section 500 disposed at the top of the copier main body, and a sheet discharging section 600 arranged between the copier main body and the image reading section 500. The copier main body includes a sheet conveying section 100 that connects the sheet feeding section 200, the image forming section 300, the fixing section 400, and the sheet discharging section 600 together.

The image forming section 300 forms a predetermined toner image on a sheet in accordance with the electrophotographic scheme. The image forming section 300 includes a photoreceptor drum 301 pivotally supported so as to be rotatable, and a charging unit 302, an exposure unit 303, the developing unit (developing apparatus) 20, a transfer unit 305, and a cleaning unit 306 which are arranged around the photoreceptor drum 301 along a rotating direction A thereof. The developing unit 20 develops an electrostatic latent image using toner, to form a toner image on a surface of the photoreceptor drum 301.

The fixing section 400 is arranged on a downstream side of the image forming section 300 in a sheet conveying direction. The fixing section 400 heats a sheet sandwiched between rollers of a pair of rollers (heating roller 401 and pressuring roller 402) and having a toner image transferred thereto by the image forming section 300, to fix the toner image to the sheet. Furthermore, the term "sheet" as used herein means any recording media on which images can be formed, for example, high-quality ordinary paper, print-only sheets, copy sheets, tracing paper, cardboards, and OHP sheets.

The image reading section 500 radiates light from an exposure lamp to a document loaded on contact glass not depicted in the drawings, to guide reflected light to a photoelectric conversion section via a reflecting mirror, thus reading image information from the document.

The sheet feeding section 200 includes a plurality of sheet feeding cassettes 201, 202, and 221. The sheet feeding cassettes 221 serves as a bypass tray that allows sheets to be supplied through a side surface of the copier and can be closed by a cover portion 222.

A sheet conveying path 110 is connected to each of the sheet feeding cassettes 201, 202, and 221. The sheet conveying paths 110 extend toward the image forming section 300 and further toward the sheet discharging section 600 via the fixing section 400. The sheet conveying paths 110 provide the sheet conveying section 100. Furthermore, a sheet for which copying is complete is discharged onto a sheet discharging tray 610 through a pair of discharging rollers 605 of the sheet discharging section 600.

Figure 7:
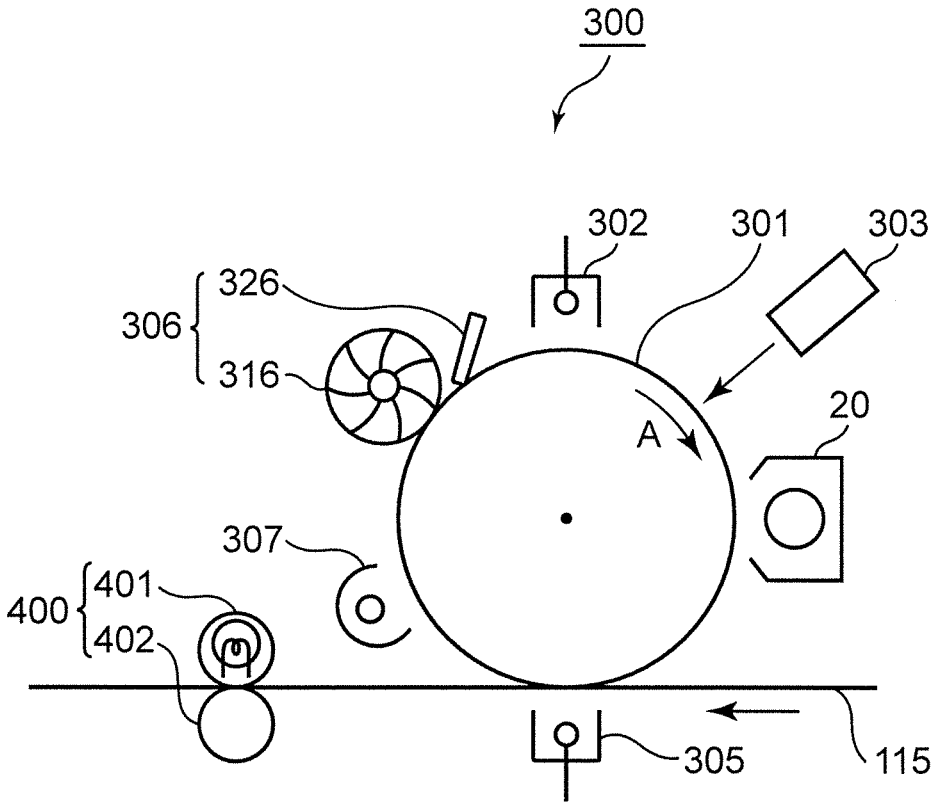
FIG. 7 is a schematic diagram depicting the periphery of an image forming section of the copier depicted in FIG. 5.

FIG. 7 is a schematic diagram depicting the periphery of the image forming section 300 of the copier 60. The image forming section 300 is a section that forms a predetermined toner image on a recording sheet 115 by means of an electrophotographic process. The image forming section 300 includes, in order, the charging unit 302, the exposure unit 303, the developing unit 20, the transfer unit 305, an electrostatic eliminating unit 307, and the cleaning unit 306 which are arranged around the photoreceptor drum 301, which is photosensitive, along the rotating direction A thereof. The electrostatic eliminating unit 307 and the cleaning unit 306 may be arranged in the reverse order.

The charging unit 302 induces corona discharge to apply a predetermined potential to the surface of the photoreceptor drum 301. The exposure unit 303 irradiates the desired image with corresponding light to selectively attenuate the surface potential of the photoreceptor drum 301, forming an electrostatic latent image. The developing unit 20 develops an electrostatic latent image formed on the surface of the photoreceptor drum 301 using toner, to form a toner image. The developing unit 20 is what is called a touchdown developing apparatus as described later. The transfer unit 305 transfers the toner image formed on the photoreceptor drum 301 onto the recording sheet 115. The electrostatic eliminating unit 307 eliminates surface charge remaining on the photoreceptor drum 301 in an electrostatic manner using lamp light. The cleaning unit 306 includes a fur brush 316 and a rubber blade 326 to remove toner, an additive therefor, and the like remaining on the surface of the photoreceptor drum 301. The cleaning unit 306 in the illustrated example includes both the fur brush 316 and the rubber blade 326 but may have only one of these components 316 and 326.

The recording sheet 115 with the toner image transferred thereto by the image forming section 300 is heated and pressed by the fixing section 400 (heating roller 401 and pressing roller 402) whereby the toner image is fixed to the recording sheet. The recording sheet 115 is then discharged onto the sheet discharging tray by a sheet discharging roller (not depicted in the drawings).

The specific image forming apparatus has been described taking the copier by way of example. However, the present embodiment is not limited to the copier, and a facsimile apparatus, a printer, and the like may be used as long as the facsimile apparatus, the printer, and the like are image forming apparatuses utilizing the electrophotographic scheme.

Furthermore, the image carrier has been described taking the photoreceptor drum, a drum-shaped photoreceptor, by way of example. However, the present embodiment is not limited to the photoreceptor drum but is applicable to a belt-like photoreceptor, a sheet-like photoreceptor, and the like.

Moreover, in the above description, the image forming apparatus is an apparatus that transfers a toner image directly to a sheet. However, the present embodiment is not limited to such an image forming apparatus. For example, what is called a tandem color image forming apparatus may be used which temporarily transfers a toner image in a plurality of colors to an intermediate transfer belt and then transfers, to a sheet, the toner image in the plurality of colors transferred to the intermediate transfer belt as depicted in FIG. 8.

Figure 8:
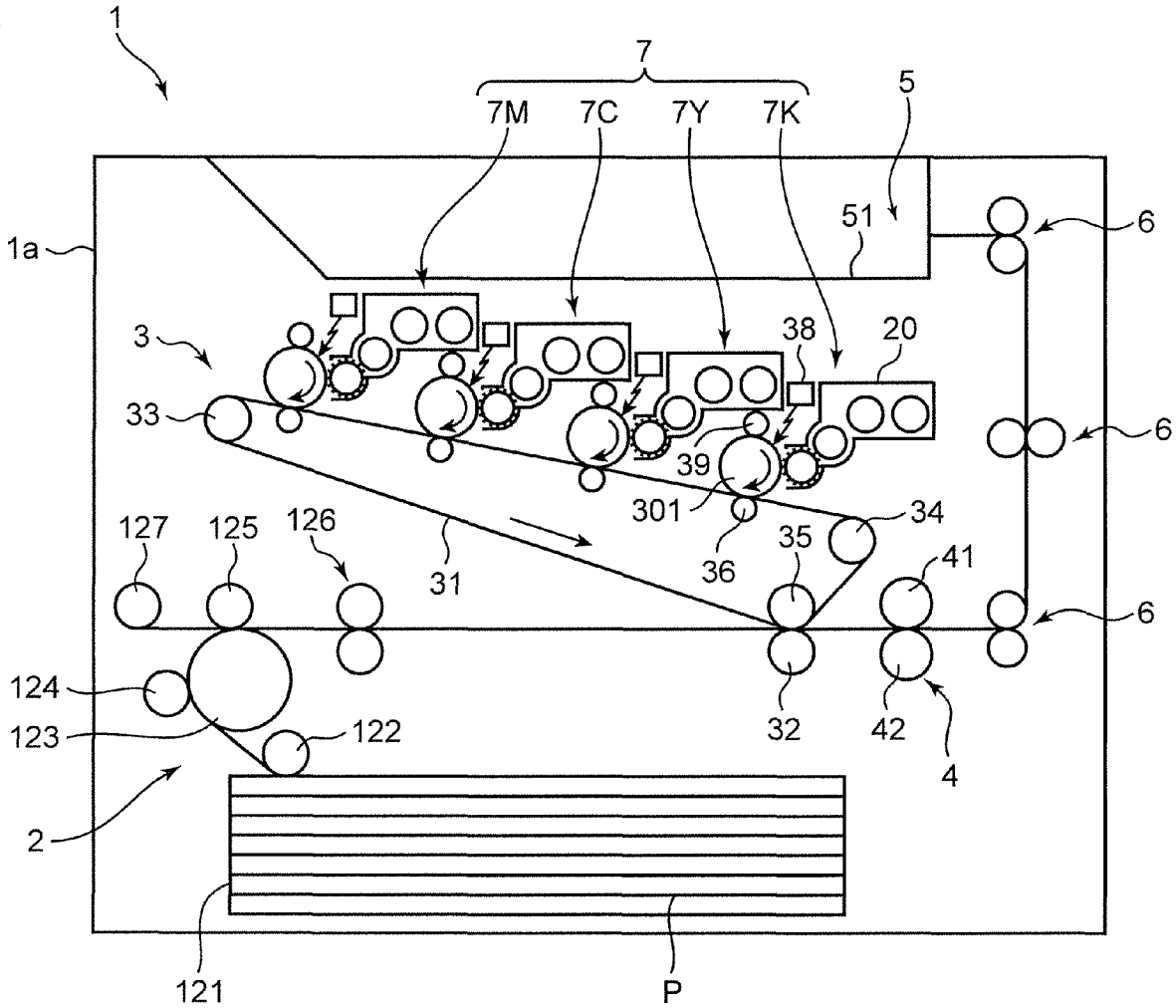
FIG. 8 is a schematic diagram depicting a configuration of another image forming apparatus to which the developing apparatus according to the embodiment of the present disclosure is applied.

FIG. 8 is a schematic diagram depicting a configuration of another image forming apparatus to which the developing apparatus according to the embodiment of the present disclosure is applied.

The image forming apparatus 1 has a box-shaped equipment main body 1*a* as depicted in FIG. 8. The equipment main body 1*a* is internally provided with a sheet feeding section 2 that feeds a sheet P, an image forming section 3 that transfers a toner image based on image data and the like to the sheet P fed from the sheet feeding section 2 while conveying the sheet P, and a fixing section 4 that fixes, to the sheet P, an unfixed toner image transferred onto the sheet P by the image forming section 3. Moreover, a sheet discharging section 5 is provided in an upper surface of the equipment main body 1*a* so that the sheet P subjected to the fixing process by the fixing section 4 is discharged into the sheet discharging section 5.

The sheet feeding section 2 includes a sheet feeding cassette 121, a pickup roller 122, sheet feeding rollers 123, 124, and 125, and a registration roller pair 126. The sheet feeding cassette 121 is provided so as to be removable from the equipment main body 1*a* and stores sheets P of appropriate sizes. The pickup roller 122 is provided at an upper left position, depicted in FIG. 6, with respect to the sheet feeding cassette 121 to pick up the sheets P stored in the sheet feeding cassette 121 one by one. The sheet feeding rollers 123, 124, and 125 feed the sheet P picked up by the pickup roller 122 out to a sheet conveying path. The registration roller pair 126 temporarily keeps the sheet P fed out into the sheet conveying path by the sheet feeding rollers 123, 124, and 125, in a standby state, and at a predetermined timing, supplies the sheet P to a secondary transfer nip between a secondary transfer roller 32 and a backup roller 35.

Furthermore, the sheet feeding section 2 further includes a manual tray not depicted in the drawings and which is attached to a left side surface, depicted in FIG. 6, of the equipment main body 1*a* and a pickup roller 127. The pickup roller 127 picks up the sheet P loaded in the manual tray. The sheet P picked up by the pickup roller 127 is fed out into the sheet conveying path by the sheet feeding rollers 123 and 125, and at a predetermined timing, supplied to the secondary transfer nip between the secondary transfer roller 32 and the backup roller 35 by the registration roller pair 126.

The image forming section 3 includes an image forming unit 7, the intermediate transfer belt 31 to a surface (contact surface) of which a toner image based on image data transmitted by a computer or the like is primarily transferred by the image forming unit 7, and the secondary transfer roller 32 that allows the toner image on the intermediate transfer belt 31 to be secondarily transferred to the sheet P fed from the sheet feeding cassette 21.

The image forming unit 7 includes a black unit 7K, a yellow unit 7Y, a cyan unit 7C, and a magenta unit 7M sequentially arranged from an upstream side (right side in FIG. 8) toward a downstream side. In each of the units 7K, 7Y, 7C, and 7M, the photoreceptor drum 301, which serves as the image carrier, is arranged at a central position so as to be rotatable in the direction of an arrow (clockwise). Around each photoreceptor drum 301, a charger 39, an exposure apparatus 38, the developing apparatus (developing unit) 20, and a cleaning apparatus, an electrostatic eliminator, and the like not depicted in the drawings are arranged in order from the upstream side in the rotating direction of the photoreceptor drum 301.

The charger 39 uniformly charges a peripheral surface of the photoreceptor drum 301 rotated in the direction of arrow. Examples of the charger 39 include a corotron and scorotron chargers based on a noncontact discharge scheme, and a charging roller and a charging brush based on a contact scheme. The exposure apparatus 38 is what is called a laser scan unit and irradiates the peripheral surface of the photoreceptor drum 301 uniformly charged by the charger 39, with laser light based on image data input by an image reading apparatus or the like, to form an electrostatic latent image based on the image data, on the photoreceptor drum 301. The developing unit 20 develops the electrostatic latent image formed on the surface of the photoreceptor drum 301 using toner, to form a toner image. The developing unit 20 is what is called a touchdown developing apparatus described below. The toner image is primarily transferred to the intermediate transfer belt 31. The cleaning apparatus removes the toner remaining on the peripheral surface of the photoreceptor drum 301 after the primary transfer of the toner image to the intermediate transfer belt 31 ends. The electrostatic eliminator eliminates electricity from the peripheral surface of the photoreceptor drum 301 after the primary transfer ends. The peripheral surface of the photoreceptor drum 301 cleaned by the cleaning apparatus and the electrostatic eliminator is directed to the charger for a new charging process. Then, new primary transfer is performed on the peripheral surface.

The intermediate transfer belt 31 is an endless belt-like rotator and is passed around a plurality of rollers such as a driving roller 33, a driven roller 34, the backup roller 35, and a primary transfer roller 36 so that a front surface (contact surface) side of the intermediate transfer belt 31 comes into abutting contact with the peripheral surface of each photoreceptor drum 301. Furthermore, the intermediate transfer belt 31 is rotated endlessly by the driving roller 33 while being pressed against each photoreceptor drum 301 by the primary transfer roller 36 arranged opposite the photoreceptor drum 301. The driving roller 33 is rotationally driven by a driving source such as a stepping motor to exert a driving force needed to endlessly rotate the intermediate transfer belt 31. The driven roller 34, the backup roller 35, and the primary transfer roller 36 are rotatably provided and rotated in a driven manner in conjunction with the endless rotation of the intermediate transfer belt 31 by the driving roller 33. The rollers 34, 35, and 36 are rotated in a driven manner in conjunction with the driving rotation of the driving roller 33 via the intermediate transfer belt 31, and support the intermediate transfer belt 31.

The primary transfer roller 36 applies a primary transfer bias (having a polarity opposite to the charging polarity of the toner) to the intermediate transfer belt 31. This allows the toner image formed on each photoreceptor drum 301 to be sequentially transferred (primary transfer) to the intermediate transfer belt 31 in a recoating manner between the photoreceptor drum 301 and the primary transfer roller 36, the intermediate transfer belt 31 being driven by the driving roller 33 to rotate circumferentially in the direction of an arrow (counterclockwise).

The secondary transfer roller 32 applies a secondary transfer bias with a polarity opposite to the polarity of the toner image to the sheet P. This allows the toner image primarily transferred onto the intermediate transfer belt 31 to be transferred to the sheet P through the secondary transfer nip between the secondary transfer roller 32 and the backup roller 35. Thus, a color transfer image (unfixed toner image) is transferred to the sheet P.

The fixing section 4 executes a fixing process on the transfer image transferred to the sheet P through the secondary transfer nip. The fixing section 4 includes a heating roller 41 heated by an electric heating element and a pressing roller 42 arranged opposite the heating roller 41 and a peripheral surface which is pressed against and into abutting contact with a peripheral surface of the heating roller 41.

Then, the transfer image transferred to the sheet P through the secondary transfer nip by the secondary transfer roller 32 is fixed to the sheet P by means of the fixing process based on heating during passage of the sheet P between the heating roller 41 and the pressing roller 42. The sheet P subjected to the fixing process is discharged to the sheet discharging section 5. Furthermore, in the image forming apparatus 1 of the present embodiment, a conveying roller pair 6 is disposed at an appropriate position between the fixing section 4 and the sheet discharging section 5.

The sheet discharging section 5 is formed by recessing the top of the equipment main body 1*a* of the image forming apparatus 1. A sheet discharging tray 51 in which discharged sheets P are received is formed at the bottom of the recessed portion.

The use of the image forming apparatus configured as described above allows stable, high-quality images to be formed.

EXAMPLES

The present disclosure will be further specifically described using examples. However, the present disclosure is not limited by these examples.

Test Example 1

Manufacture of Developing Rollers

Materials Used:

Resin: soluble nylon resin (manufactured by TORAY INDUSTRIES, INC.; "CM8000" (product name))

Conductive fine particles: titanium oxide "ET300W" (product name), manufactured by ISHIHARA SANGYO KAISHA, LTD., a primary average particle size of 30 to 60 nm

Examples 1 to 4

First, a method for manufacturing a developing roller according to examples is illustrated below.

Developing rollers were produced to have a resin layer on the surface thereof as depicted in FIG. 1A and FIG. 1B.

Specifically, first, a resin coating agent was obtained by using a ball mill to mix 100 mass % soluble nylon resin and 75 mass % conductive fine particles, for 72 hours, into a solvent containing an alcoholic solvent (methanol) and non-aqueous solvent (toluene) compounded in such a ratio as depicted in Table 2, so as to set the concentration of solids to 15 mass %. Numerical values for solvents in Table 2 are indicative of ratios.

Then, a resin layer was formed on a support base by dipping an alumite sleeve of diameter 20 mm in the resin coating agent to coat the sleeve with the coating agent so as to set the layer thickness of the resultant resin layer to 5 μm.

Subsequently, the coated support base was heated and dried at 120° C. for 60 minutes. Thus, developing rollers according to Examples 1 to 4 were obtained in which the surface portion consisting of the resin layer.

Comparative Examples 1 to 5

Developing rollers were manufactured in the same manner as Example 1 except that no solvent was used (Comparative Example 1) or the compounding ratio between the alcoholic solvent and the non-aqueous solvent in the whole solvent was changed to ratios as depicted in Table 2.

(Evaluation)

Evaluation tests for developing performance were conducted using the developing rollers obtained in the examples and the comparative examples under demonstration test conditions depicted in Table 1.

TABLE 1

| | |
|---|---|
| Print speed | 30 sheets/min |
| Photoreceptor peripheral speed | 180 mm/sec |
| Developing roller | Rollers obtained in examples and comparative examples |
| Toner carrier peripheral speed | Peripheral speed ratio of toner carrier to photoreceptor (with-rotation): 1.5 |
| Magnet roller peripheral speed | Peripheral speed ratio of magnet roller to developing roller (counter rotation): 1.1 |
| Distance from photoreceptor to developing roller | 0.12 mm |
| Distance from developing roller to magnet roller | 0.3 mm |
| Photoreceptor potential | V0 = 430 V, VL = 100 V |
| Photoreceptor | OPC |
| Toner carrier bias | Frequency = 3.7 kHz, duty = 27%, Vpp = 1500 V, Vdc = 190 V |
| Magnet roller bias | Frequency = 3.7 kHz, duty = 73%, Vpp = 650 V, Vdc = 490 V |
| Toner | 6.8 μm, positive chargeability |

(Development Property 1: Development Ghost Evaluation)

Figure 9:
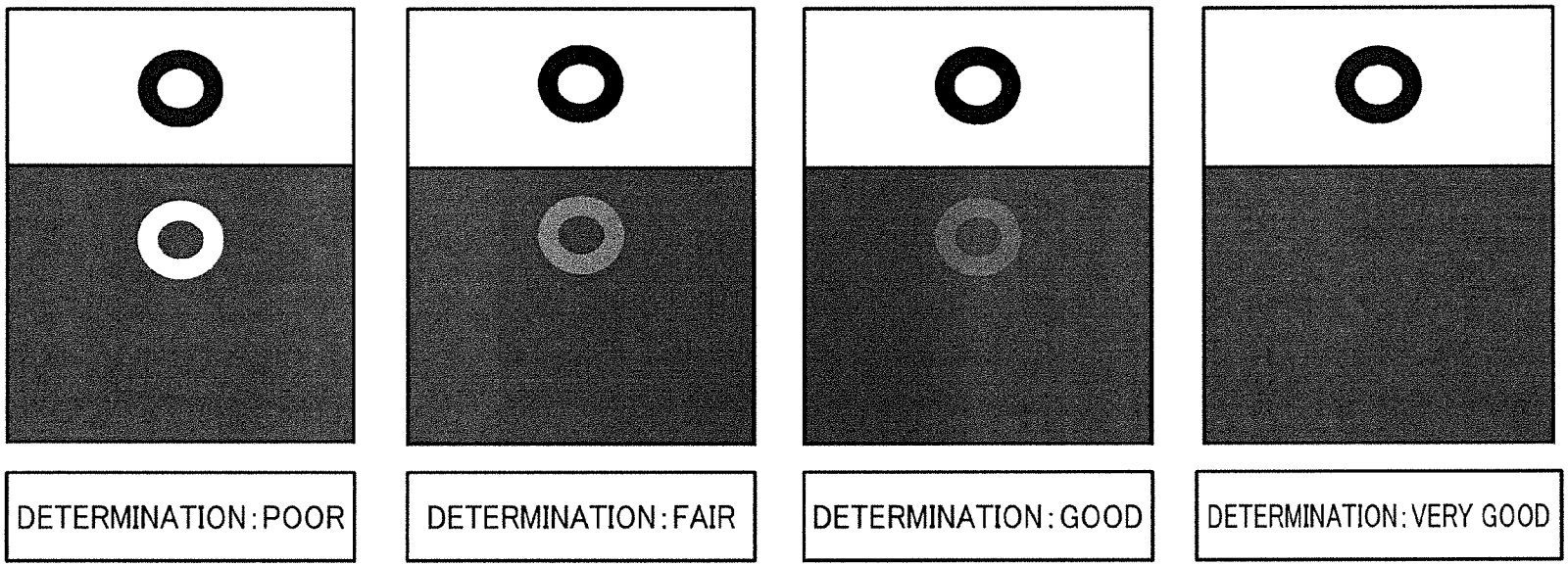
FIG. 9 is a diagram depicting evaluation criteria for development ghost evaluation in examples.

A document that was white paper printed in solid black and on which a gray image was then printed was output, and an afterimage was visually evaluated in accordance with criteria depicted in FIG. 9.

(Development Property 2: Image density)

Image density was measured using a spectrophotometer SpectroEye. The effective range of the image density is 1.5 to 1.

(Surface Roughness, and Waviness Cycle and Height)

Surface roughness and waviness cycle and height were measured using Wyko NT1100, Optical Profiling System (three-dimensional interference fringe microscope) manufactured by Veeco.

The results are shown in Table 2.

TABLE 2

| | Alcohol methanol | Non-aqueous toluene | Ratio of non-aqueous solvent | Ra/μm | Waviness cycle | Waviness height | Developing performance Property 1 | Developing performance Property 2 |
|---|---|---|---|---|---|---|---|---|
| Example 1 | 7 | 3 | 30% | 0.45 | 100 | 2.9 | Good | 1.42 |
| Example 2 | 4 | 2 | 33% | 0.65 | 200 | 4 | Very good | 1.47 |
| Example 3 | 3 | 2 | 40% | 0.8 | 300 | 5 | Very good | 1.45 |
| Example 4 | 3 | 3 | 50% | 0.89 | 380 | 7 | Very good | 1.46 |
| Comparative Example 1 | | | 0% | 0.25 | 0 | 0 | Poor | 1.2 |
| Comparative Example 2 | 6 | 1 | 14% | 0.23 | 0 | 0 | Poor | 1.23 |
| Comparative Example 3 | 5 | 1 | 17% | 0.22 | 0 | 0 | Poor | 1.2 |
| Comparative Example 4 | 4 | 1 | 20% | 0.25 | 0 | 0 | Poor | 1.23 |
| Comparative Example 5 | 3 | 1 | 25% | 0.3 | 50 | 1 | Fair | 1.3 |

Figure 10:
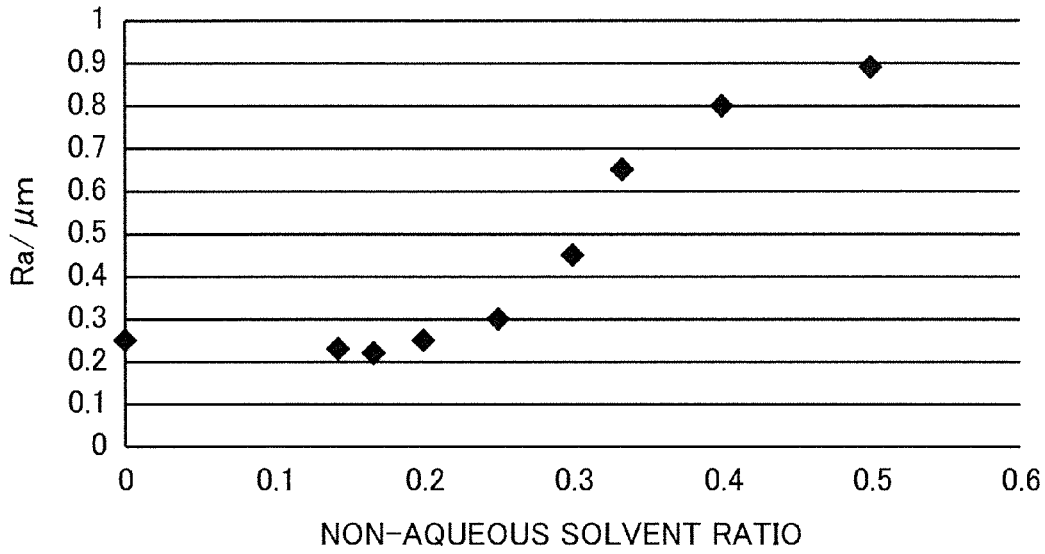
FIG. 10 is a graph depicting the relation between the surface roughness of the developing roller and a non-aqueous solvent ratio in examples.
Figure 11:
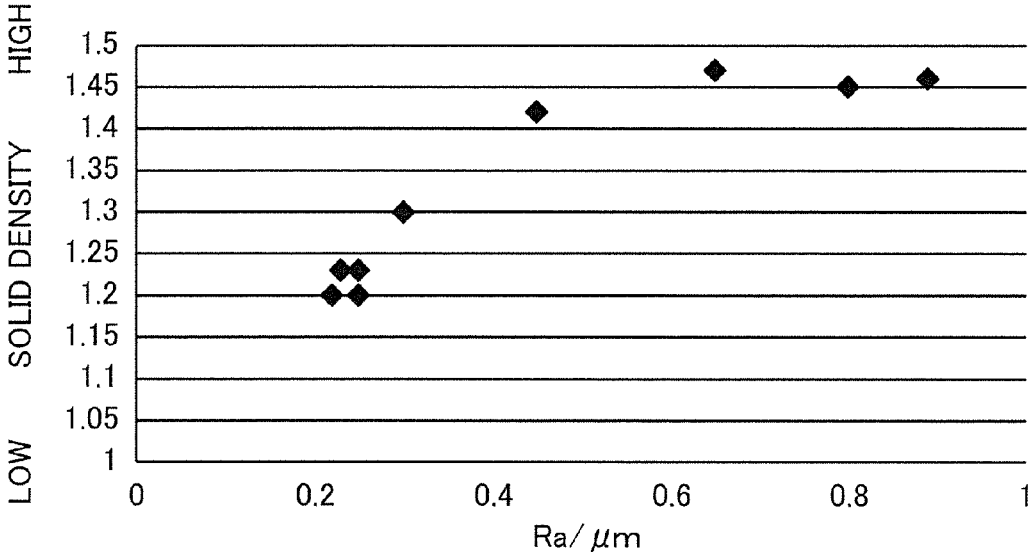
FIG. 11 is a graph depicting the relation between development property (image density) and the surface roughness of the developing roller in examples.

Furthermore, FIG. 10 shows the relation between the surface roughness Ra of the developing roller and the non-aqueous solvent ratio in Examples 1 to 4 and Comparative Examples 1 to 5. FIG. 11 depicts the relation between the surface roughness Ra of the developing roller and the image density in Examples 1 to 4 and Comparative Examples 1 to 5.

As is apparent from the results shown above, a developing roller that can exhibit excellent development properties is obtained when the surface roughness of the developing roller and the shape of the surface roughness fall within the range of the present disclosure. On the other hand, the image density was low and development ghosts occurred in the comparative examples in which the surface roughness of the developing roller was less than 0.4 μm and in which the shape of the roughness departed from the range of the present disclosure (in Comparative Examples 1 to 4, measuring the height and cycle was impossible because no waviness occurred). This could be ascribed to the large contact area between the sleeve and the toner, causing the sleeve to exert an increased electrically attractive force on the toner to prevent a desired amount of toner from flying to the photoreceptor.

Furthermore, it has been found that the surface roughness of the developing roller and the shape of the surface roughness can be adjusted to within the ranges of the present disclosure using the compounding ratio of the non-aqueous solvent to the whole solvent (see FIG. 10, etc.).

Test Example 2

Examples 5 to 10 and Comparative Examples 6 to 8

Developing rollers were manufactured in the same manner as Example 1 except that, for the solvent in the resin coating agent, the types of the alcoholic solvent and the non-aqueous solvent and the compounding ratio were changed as depicted in Table 3. Then, developing performance evaluations similar to those in Test Example 1 were performed. The results are shown in Table 3.

Table 3 indicates that, even if any of various combinations of alcoholic solvents and non-aqueous solvents is used as a solvent for the resin coating agent, a developing roller that can exhibit excellent development properties is obtained as long as the surface roughness of the developing roller and the shape of the surface roughness can be adjusted to fall within the ranges of the present disclosure.

TABLE 3

| No | Alcoholic solvent | | Non-aqueous solvent | Non-aqueous solvent ratio | Ra/μm | Waviness cycle | Waviness height | Developing performance Property 1 | Developing performance Property 2 |
|---|---|---|---|---|---|---|---|---|---|
| Comparative Example 6 | Methanol 3 | | Xylene 1 | 25% | 0.28 | 50 | 0.9 | Fair | 1.3 |
| Example 5 | Methanol 7 | | Xylene 3 | 30% | 0.47 | 115 | 3 | Good | 1.41 |
| Example 6 | Methanol 3 | | Xylene 2 | 40% | 0.82 | 280 | 4.5 | Very good | 1.44 |
| Comparative Example 7 | Methanol 2 | Butanol 1 | Toluene 1 | 25% | 0.31 | 50 | 0.8 | Fair | 1.31 |
| Example 7 | Methanol 3.5 | Butanol 3.5 | Toluene 3 | 30% | 0.46 | 100 | 2.6 | Good | 1.42 |
| Example 8 | Methanol 1 | Butanol 2 | Toluene 2 | 40% | 0.78 | 185 | 4 | Very good | 1.49 |
| Comparative Example 8 | Ethanol 3 | | Toluene 1 | 25% | 0.32 | 50 | 0.8 | Fair | 1.27 |
| Example 9 | Ethanol 7 | | Toluene 3 | 30% | 0.39 | 85 | 2.5 | Good | 1.38 |
| Example 10 | Ethanol 3 | | Toluene 2 | 40% | 0.71 | 205 | 4 | Very good | 1.42 |

Comparative Example 9

Developing rollers were manufactured in the same manner as Example 1 except that a resin coating agent with 10 parts by mass PTFE fine particles (central particle size: 8 μm) added to resin components was used in Comparative Example 4, described above. Then, developing performance evaluations similar to those in Test Example 1 were performed. The results are shown in Table 4.

TABLE 4

| | Alcohol methanol | Non-aqueous toluene | Non-aqueous solvent ratio | Added fine particles (10 parts by mass with respect to resin) | Ra/μm | Waviness cycle | Waviness height | Developing performance Property 1 | Developing performance Property 2 |
|---|---|---|---|---|---|---|---|---|---|
| Comparative Example 9 | 4 | 1 | 20% | PTFE particle | 0.57 | 0 | 0 | Poor | 1.18 |

Thus, as is apparent from Table 4, it has been found that the developing performance is degraded when the resin layer is blended with fine particles such as PTFE fine particles which are on the negative side of the triboelectric series. This is expected to be because the PTFE fine particles are on the negative side of the triboelectric series and frictional charging causes the PTFE fine particles on the sleeve to be negatively charged and thus electrically attracted to positively charged toner, preventing the toner from being formed into a latent image on the photoreceptor.

This indicates that the surface roughness of the developing roller and the shape of the surface roughness are preferably adjusted by using the solvent for the resin coating agent as in the present disclosure rather than by adding fine particles.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing roller having a conductive support base, a surface of which is covered with a resin layer, wherein the resin layer contains conductive fine particles and soluble nylon serving as a binder resin, and the resin layer surface has a surface roughness Ra of at least 0.4 μm, a waviness curve cycle of 50 to 400 μm, and a waviness curve height of 2 to 10 μm.

2. The developing roller according to claim 1, wherein the conductive support base has a surface roughness Ra of 0.6 μm or less.

3. The developing roller according to claim 1, wherein the surface roughness of the resin layer surface does not result from the particles contained in the resin layer.

4. The developing roller according to claim 1, wherein a solvent for a resin coating agent forming the resin layer comprises an alcoholic solvent and a non-aqueous solvent, and a compounding ratio of the non-aqueous solvent to a whole solvent is at least 30%.

5. The developing roller according to claim 1, which is produced by dipping.

6. A developing apparatus that develops an electrostatic latent image, formed on a surface of an image carrier, into a toner image, the developing apparatus comprising:

a magnetic roller that carries, on a surface thereof, a two-component developer containing toner and a carrier to convey the borne two-component developer; and a developing roller arranged opposite the image carrier and also opposite the magnetic roller in contact with or proximity to the two-component developer conveyed by the magnetic roller, to carry toner in the two-component developer on a surface of the developing roller thereby conveying the borne toner to a vicinity of the image carrier, the developing apparatus further comprising the developing roller according to claim 1 as the developing roller.

7. An image forming apparatus comprising the developing apparatus and the image carrier according to claim 6.

* * * * *